United States Patent [19]

Bodine

[11] 4,218,849

[45] Aug. 26, 1980

[54] SONIC METHOD AND APPARATUS FOR ACTIVATING A FLUID IN TREATING MATERIAL OR POLISHING PARTS EMPLOYING COUPLING RESONATOR MEMBER

[76] Inventor: Albert G. Bodine, 7877 Woodley Ave., Van Nuys, Calif. 91406

[21] Appl. No.: 953,681

[22] Filed: Oct. 23, 1978

[51] Int. Cl.[2] ..... B24B 31/02; B24B 1/00

[52] U.S. Cl. ..... 51/7; 51/317

[58] Field of Search ..... 51/7, 17, 163.1, 313, 51/317

[56] References Cited

U.S. PATENT DOCUMENTS

| | | | |
|---|---|---|---|
| 3,187,473 | 6/1965 | Ruppe | 51/7 X |
| 3,380,195 | 4/1968 | Bodine | 51/7 |
| 3,496,677 | 2/1970 | Bodine | 51/7 |
| 3,544,292 | 12/1970 | Bodine | 51/7 |
| 3,596,406 | 8/1971 | Bodine | 51/7 |
| 3,596,407 | 8/1971 | McKinney | 51/7 |

*Primary Examiner*—Gary L. Smith

*Attorney, Agent, or Firm*—Edward A. Sokolski

[57] ABSTRACT

One or more elongated members, such as bars or tubes of an elastic material are sonically vibrated, by means of a mechanical oscillator coupled thereto, at a frequency such as to set up resonant elastic standing wave vibration in the elastic resonators. A conduit or chamber is provided in which material to be treated or parts to be polished along with an appropriate fluid treatment material are placed, the parts and material either being flowed through the conduit or retained therein for a predetermined treatment time. Sonic energy is coupled from the resonator member or members to the treatment conduit at selected positions along the standing waves generated in the resonators, this coupling being made adjacent the node and anti-node of such vibration in one embodiment; at two anti-nodes in a second embodiment, and a single anti-node in a third embodiment, to obtain various types of vibratory motion in the treatment conduit or chamber for various effects on the parts or other material being treated.

16 Claims, 6 Drawing Figures

SONIC METHOD AND APPARATUS FOR ACTIVATING A FLUID IN TREATING MATERIAL OR POLISHING PARTS EMPLOYING COUPLING RESONATOR MEMBER

This invention relates to a method and apparatus employing sonic energy for activating a fluid body such as for fluid treatment as in chemical processes or for polishing of parts, and more particularly to such method and apparatus in which the sonic energy is generated in a resonator system and selectively coupled from such system to a treatment conduit or chamber where the parts may be polished or otherwise cause treatment of the fluid material.

A well known technique for polishing and cleaning parts involves the immersion of such parts in a grit or abrasive particle medium in a barrel or other such chamber which is vibrated to effect a bodily shaking whereby the abrasive medium together with the parts impact against each other to effect the polishing action. I have found that much more efficient polishing can be accomplished by subjecting the parts and the grit to resonant sonic vibratory action generated in a resonant vibration system by means of an orbiting mass oscillator. The use of resonant vibratory energy for cleaning and polishing is described in my U.S. Pat. No. 3,380,195, issued Apr. 30, 1968, my U.S. Pat. No. 3,544,292, issued Dec. 1, 1970, and my U.S. Pat. No. 3,496,677, issued Feb. 24, 1970. In the last mentioned patent, parts to be cleaned and polished are fed along with an abrasive material through a conduit, this conduit being vibrated as part of a resonant vibration system by means of an orbiting mass oscillator which is coupled directly thereto. As pointed out in the aforementioned U.S. Pat. No. 3,544,292, resonant vibratory energy can be employed to remove whole cores from castings. The method and apparatus of the present invention can likewise be used for this purpose with the conduit or container which is separate and apart from the resonator system being the chamber formed in a casting which is the material being treated and the fluid being formed by the grit core to be removed from this chamber.

While these prior art approaches have been found to operate quite efficiently, many instances have arisen where it is not practicable to use a treatment conduit which has high elasticity as is necessary for efficient operation in a sonic resonant system. Particularly where the conduit must be selected for its corrosion resistant and abrasion resistant properties, it is often highly desirable to use a relatively non-elastic material such as a plastic. This of course obviates operation as described in my aforementioned U.S. Pat. No. 3,496,677, where it is necessary that the treatment conduit be of a highly elastic material such as steel for it to operate properly in a resonant vibration system.

The present invention overcomes the aforementioned shortcomings of the prior art and enables the use of a non-elastic material as a treatment chamber by employing a resonator system separate and apart from the conduit, which is positioned and arranged relative to the conduit so that energy generated therein can be efficiently coupled to the conduit to effect the desired polishing action. Various energy coupling points are provided in various embodiments of the invention to provide optimum vibration for various application requirements.

It is therfore an object of this invention to enable the use of a non-elastic treatment conduit or container in a sonic chemical process or polishing or deburring system.

It is a further object of this invention to provide means for efficiently coupling sonic energy from a resonant vibration system to a fluid treatment conduit or container.

Other objects of the invention will become apparent as the description proceeds in connection with the accompanying drawings, of which:

Figure 1:
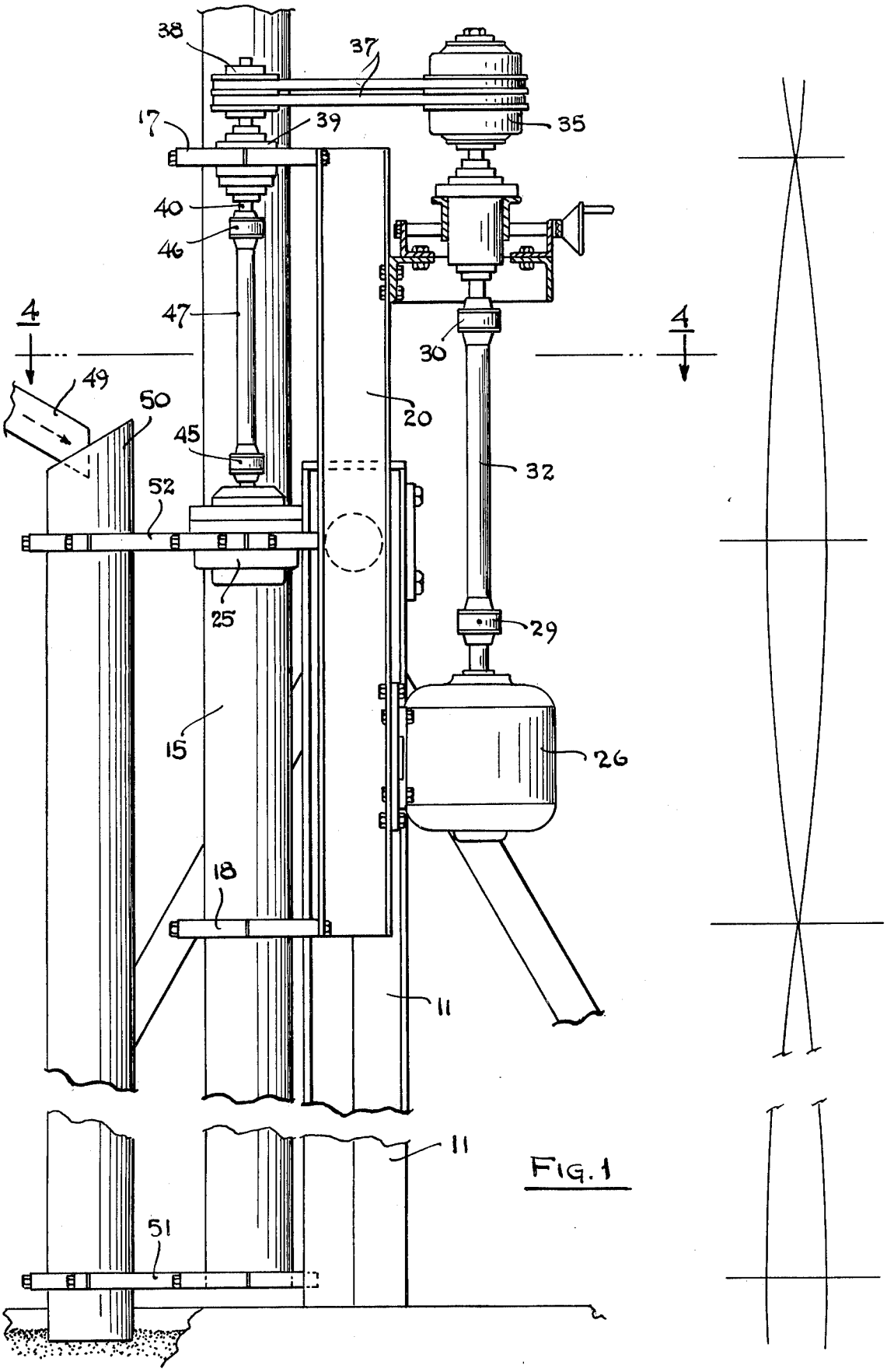
FIG. 1 is a side elevational view of a first embodiment of the invention.
Figure 2:
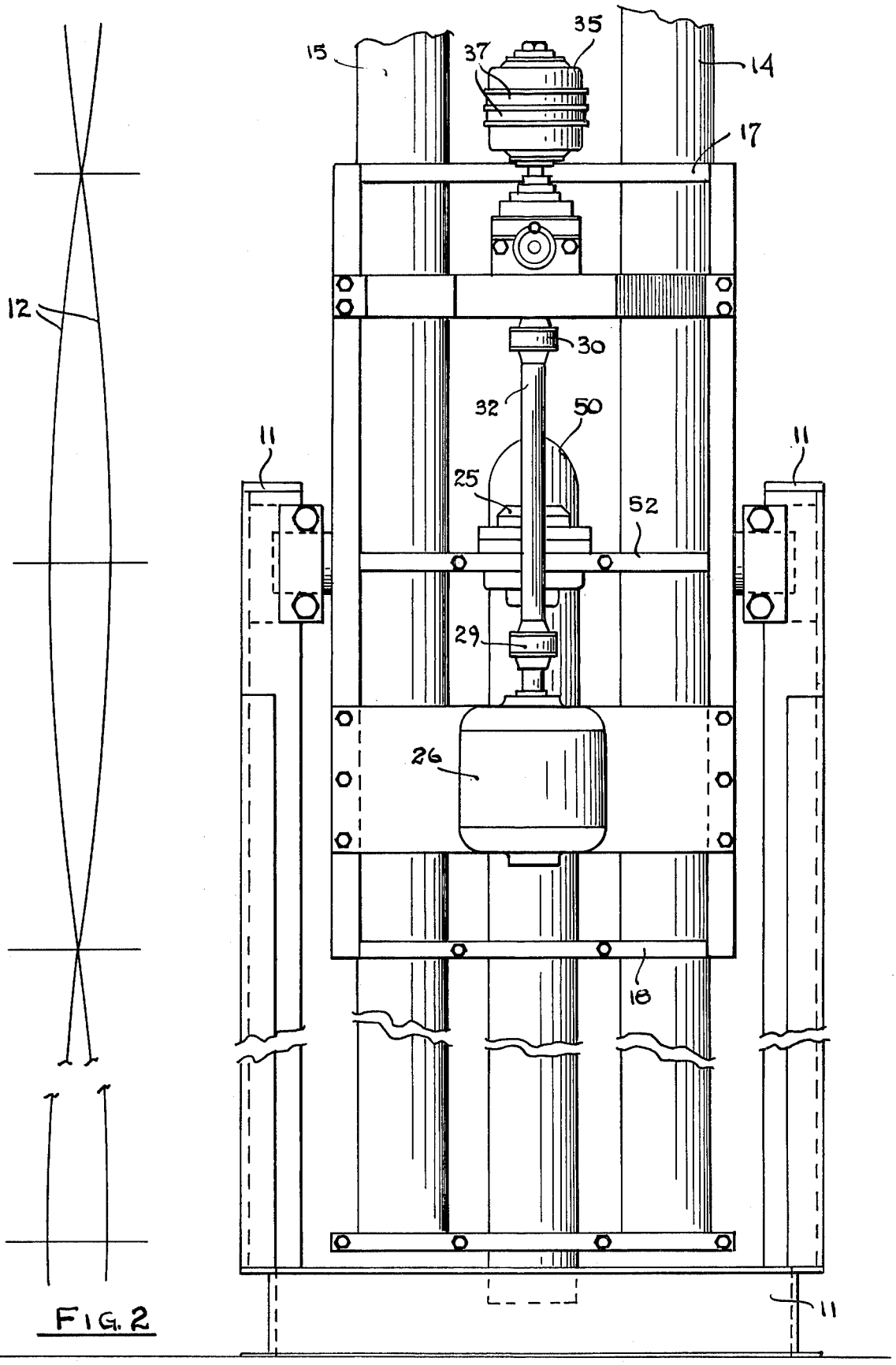
FIG. 2 is an end elevational view of the first embodiment.
Figure 3:
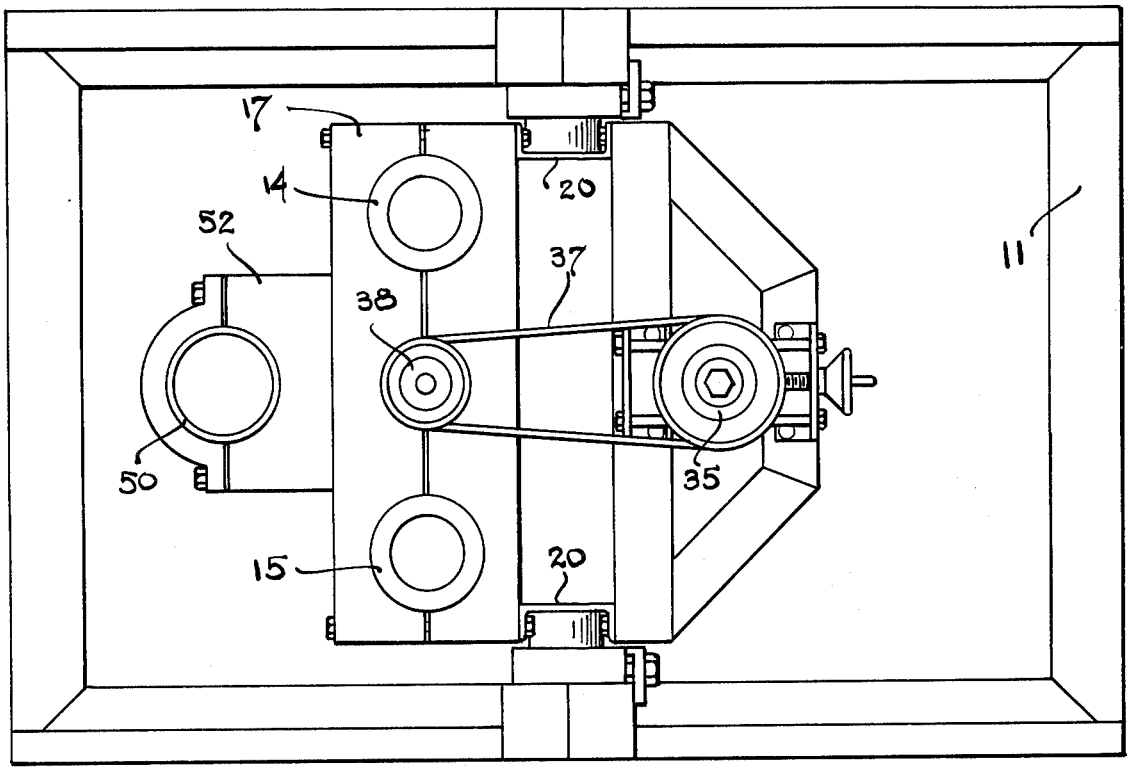
FIG. 3 is a view taken along the plane indicated by 3—3 in FIG. 1.
Figure 4:
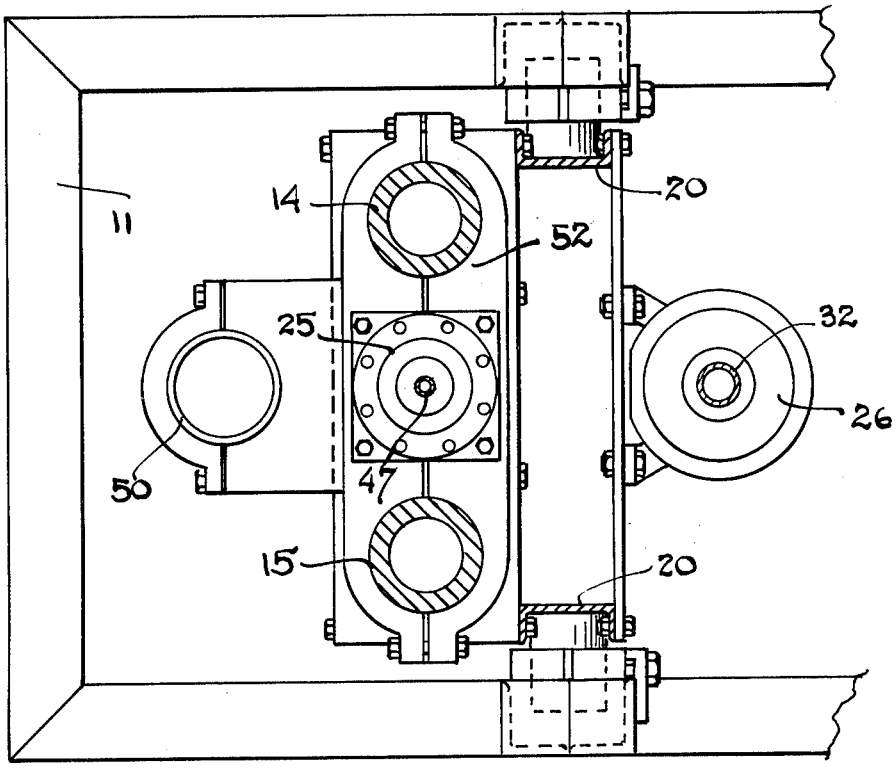
FIG. 4 is a view taken along the plane indicated by 4—4 in FIG. 1.

It has been found most helpful in analyzing the operation of the device of this invention to analogize the acoustically vibrating circuit involved in an equivalent electrical circuit. This sort of approach to analysis is well known to those skilled in the art and is described, for example, in Chapter 2 of "Sonics" by Hueter and Bolt, published in 1955 by John Wiley and Sons. In making such an analogy, force F is equated with electrical voltage #, velocity of vibration u is equated with electrical current i, mechanical compliance $C_m$ is equated with electrical capacitance $C_e$, mass M is equated with electrical inductance L, mechanical resistance (friction) $R_m$ is equated with electrical resistance R, and mechanical impedance $Z_m$ is equated with electrical impedance $Z_e$.

Thus, it can be shown that if a member is elastically vibrated by means of an acoustical sinusoidal force $F_o \sin \omega t$ ($\omega$ being equal to $2\pi$ times the frequency of vibration) that $$Z_m = R_m + j\omega M - \frac{1}{\omega C_m} = \frac{F_o \sin \omega t}{u} \quad (1)$$

Where $\omega M$ is equal to $1/\omega C_m$, a resonant condition exists, and the effective mechanical impedance $Z_m$ is equal to the mechanical resistance $R_m$, the reactive impedance components $\omega M$ and $1/\omega C_m$ cancelling each other out. Under such a resonant condition, velocity of vibration u at a maximum, power factor is unity, and energy is most efficiently delivered to a load to which the resonant system may be coupled.

It is important to note the significance of the attainment of high acoustical "Q" in the resonant system being driven, to increase the efficiency of the vibration thereof and to provide a maximum amount of energy for the surface treatment operation. As for an equivalent electrical circuit, the Q of an acoustical vibration circuit is defined as the sharpness of resonance thereof and is indicative of the ratio of the energy stored in each vibration cycle to the energy used in each such cycle. Q is mathematically equated to the ratio between $\omega M$ and $R_m$. Thus, the effective Q of the vibrating circuit can be maximized to make for highly efficient high-amplitude vibration by minimizing the effect of friction in the circuit and/or maximizing the effect of mass in such circuit.

In considering the significance of the parameters described in connection with Equation (1), it should be kept in mind that the total effective resistance, mass, and compliance in the acoustical vibration circuit are represented in the equation and that these parameters may be distributed throughout the system rather than being lumped in any one component or portion thereof.

It is also to be noted that an orbiting-mass oscillator may be utilized in the device of the invention that automatically adjusts its output frequency to maintain resonance with changes in the characteristics of the load. Thus, in the face of changes in the effective mass and compliance presented by the load, the system automatically is maintained in optimum resonant operation by virtue of the "lock-in" characteristics of applicant's unique orbiting mass oscillator. The orbiting mass oscillator automatically changes not only its frequency but its phase angle and therefore its power factor with changes in the resistive impedance load to assure optimum efficiency of operation at all times.

Referring now to FIGS. 1–4, a first embodiment of the invention is illustrated. Supported on support frame 11 are a pair of elongated resonator members 14 and 15 which are in the form of elongated tubes of a highly elastic material such as steel. Resonator members 14 and 15 are resiliently mounted on support frame 11 by means of compliant clamping plate assemblies 17 and 18 which are spaced from each other along the length of the resonator tubes at positions which correspond to nodes of the standing wave pattern 12 set up in the resonant vibration system formed by such tubes. Clamping plates 17 and 18 are mounted on frame 11 by means of brackets 20. Fixedly attached to and supported on resonator tube members 14 and 15 by means of clamping plate 52 is an orbiting mass oscillator 25. Orbiting mass oscillator 25 may be of the type described in my U.S. Pat. No. 3,217,551, and has an eccentric rotor member which when rotatably driven generates vibratory energy at a sonic frequency which depends upon the speed of rotation. Motor 26 which may be an electrical motor is fixedly supported on support plate 12 which is attached to beams 20 which in turn are supported on frame 11. The drive shaft of motor 26 is coupled through couplings 29 and 30 and shafts 32 and 33 to the input drive of a variable speed pulley assembly 35, shaft 33 being supported on bearing 34. The output of variable speed pulley assembly 35 is coupled through drive belts 37, pulley wheel 38, shaft 40, which is supported on bearing 39, couplers 45 and 46 and shaft 47 to the drive shaft of orbiting mass oscillator 25.

The speed of rotation of shaft 47 is adjusted to provide a vibratory output from oscillator 25 which causes resonant standing wave vibration of the resonator tube members 14 and 15, as indicated by standing wave graph pattern 12. Treatment conduit 50 is attached to and supported on resonator tube members 14 and 15 by means of clamping plate members 51 and 52. As can be seen from the standing wave pattern 12, the attachment of conduit 50 to the resonator tube members occurs at two anti-nodes of the standing wave pattern by virtue of the couplings to the tube members provided by clamp members 51 and 52.

Treatment conduit 50 may be fabricated of a relatively non-elastic material, such as a suitable plastic or metal. Chemical reagents to be activated by vibration are introduced in a batch manner or are flowed through said conduit 50 by means of conventional laboratory hoses (not shown). Parts to be polished are fed into conduit 50 from chute 49 along with suitable abrasive material, such as a grit formed of aluminum oxide or other metal particles, the parts being treated in the conduit and fed into tray 55 along with the grit material. The gravity angle of conduit 50 can be adjusted to provide the desired flow rate of the parts and grit material passing therethrough.

By using two or more resonant bar or tube members, gyratory vibration of the treatment conduit can be imparted without concern as to the effects of lever moment of the conduit. The coupler plate thus positions the two resonator tubes at two points of a force triangle with the treatment conduit at a third point, so that circular vibration of the tubes at the two points will result in a circular vibration at the third point where the treatment member is coupled. Such operation can be achieved by virtue of the gyratory vibration of the resonant tube members in response to the orbiting mass oscillator.

Figure 5:
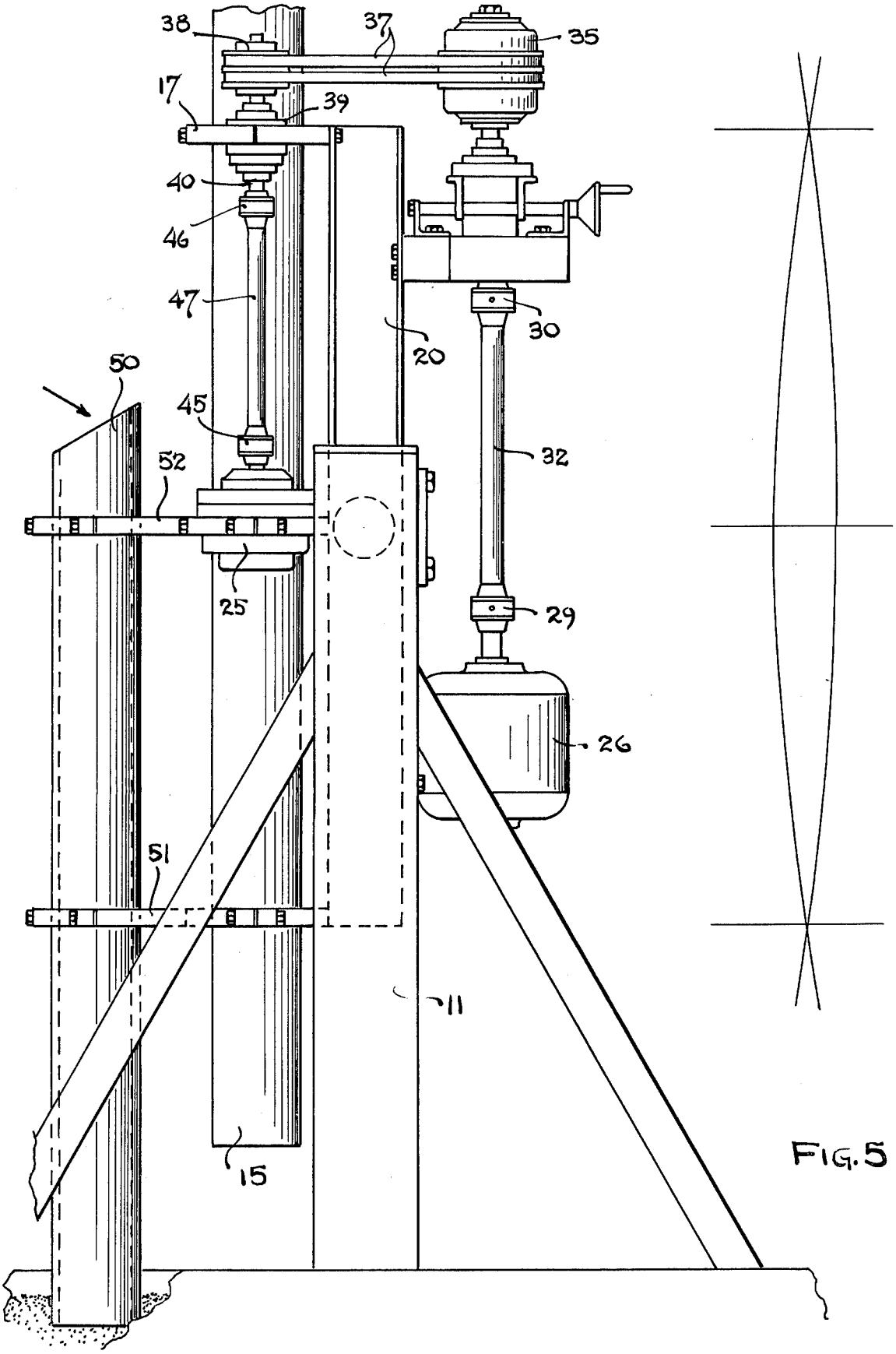
FIG. 5 is a side elevational view of a second embodiment of the invention.

Referring now to FIG. 5, a second embodiment of the invention is illustrated. This second embodiment is the same as the first except for the fact that the resonant tube members 14 and 15 are coupled to treatment conduit 50 by means of coupler plates 51 and 52 at points along the resonator members at which a node and anti-node of the standing wave pattern respectively are located. In this second embodiment, by coupling the sonic energy at two regions of the resonant system which are vibrating with different time phase, a rocking motion is imparted to the treatment tube which has been found to give better results for certain application requirements than the more uniform vibration of the first embodiment.

Figure 6:
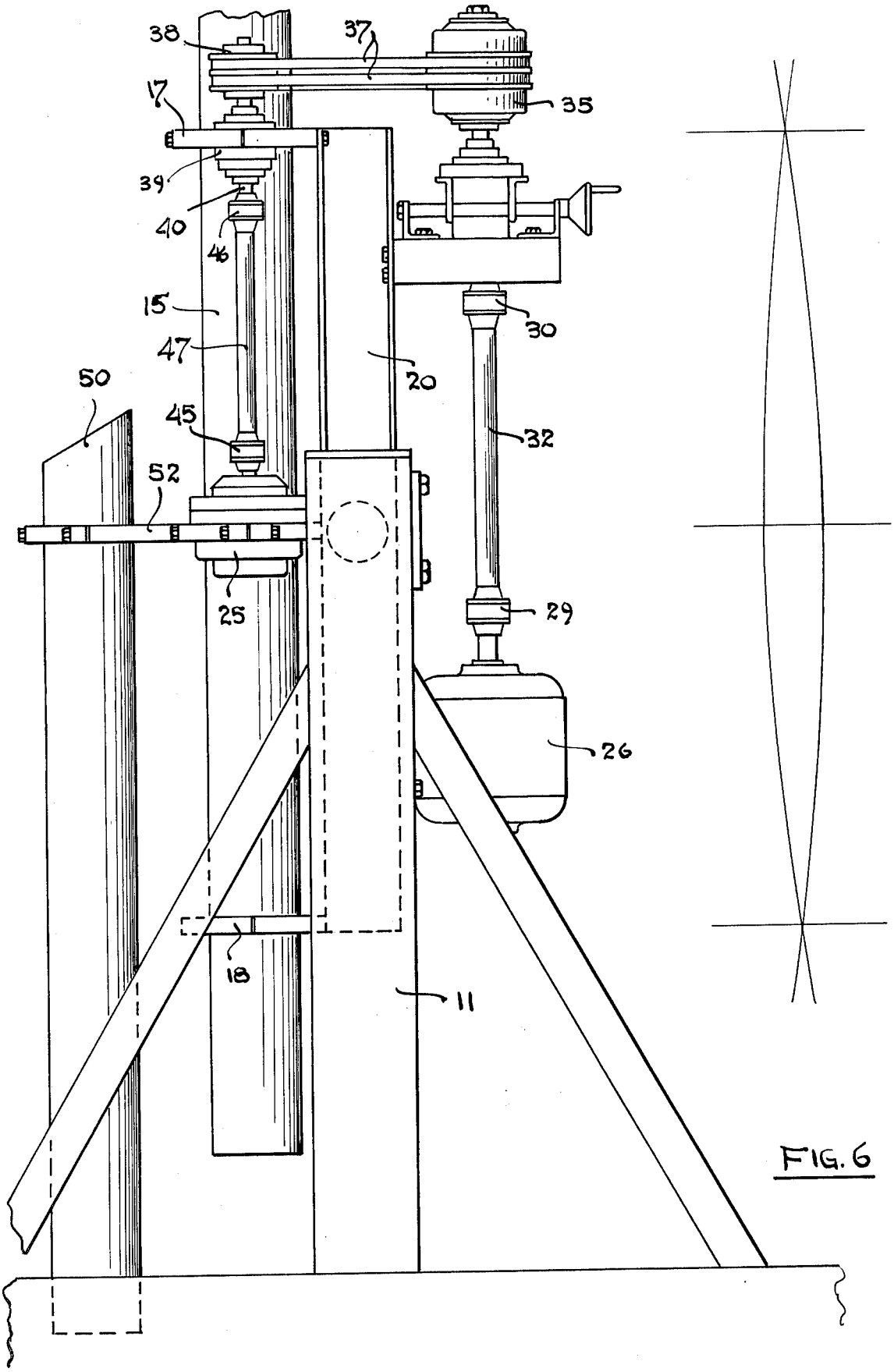
FIG. 6 is a side elevational view of a third embodiment of the invention.

Referring now to FIG. 6, still another embodiment of the invention is illustrated. This embodiment is the same as the first two except for the fact that only a single coupling 52, at an anti-node of the vibration pattern, is used between the resonator tubes 14 and 15 and the treatment conduit 50. Operation here is generally similar except that relatively uniform vibration is imparted to one end of the treatment tube.

It is to be noted that the method and apparatus of the invention can be used to equal advantage in other types of fluid treatment such as, for example, in the leaching and mixing of ores, washing operations, etc.

While the invention has been described and illustrated in detail, it is to be clearly understood that this is intended by way of illustration and example only and is not to be taken by way of limitation, the spirit and scope of this invention being limited only by the terms of the following claims.

I claim:

1. Apparatus for sonically activating a fluid in the treatment of material with vibration comprising:

elongated resonator means fabricated of an elastic material, means for sonically vibrating said resonator means in a gyratory manner at a frequency such as to effect resonant standing wave vibration thereof at a sonic frequency, container means for receiving said fluid and said material, and means for coupling sonic energy from said resonator means to said container means at a point corresponding to at least one anti-node of the standing wave vibration pattern formed along said resonator means to effect gyratory vibration of the container means.

2. The apparatus of claim 1 wherein the fluid includes an abrasive and the material being treated comprises parts to be polished and cleaned.

3. The apparatus of claim 1 wherein the container means comprises a conduit through which the parts and abrasive material are flowed.

4. The apparatus of claim 1 wherein the container means has substantially less elasticity than the resonator means.

5. The apparatus of claim 1 wherein the means for sonically vibrating said resonator means comprises an orbiting mass oscillator, a motor for rotatably driving said oscillator, and clamp means for clamping said oscillator to said resonator means and said container means at predetermined positions therealong.

6. The apparatus of claim 1 and further comprising means for clamping the motor to the resonator means at a position therealong corresponding to a node of the standing wave pattern.

7. the apparatus of claim 1 wherein the container means comprises a casting having a chamber formed therein, said casting comprising the material being treated, and the fluid comprising a grit core within said chamber to be removed therefrom.

8. A method for sonically activating a fluid in the vibratory treatment of material comprising the steps of:

resonantly vibrating an elongated elastic member at a sonic frequency so as to set up standing wave gyratory vibration therein, coupling sonic energy from said elastic member to a conduit at at least one position along said elastic member corresponding to an anti-node of the standing wave pattern to effect gyratory vibration of the conduit, and passing said fluid and said material along said conduit.

9. The method of claim 8 wherein the fluid includes an abrasive material and the material comprises parts to be polished and cleaned.

10. The method of claim 8 wherein the sonic energy is additionally coupled from the elastic member to the conduit from a second position therealong corresponding to a different anti-node of said standing wave pattern.

11. The method of claim 8 wherein the sonic energy is additionally coupled from the elastic member to the conduit from a second position therealong corresponding to a node of said standing wave pattern.

12. The method of claim 8 wherein said conduit comprises a casting having a chamber formed therein, the casting comprising the material being treated, and the fluid comprising a grit core within said chamber to be removed therefrom.

13. Apparatus for sonically activating a fluid in the treatment of material with vibration comprising:

elongated resonator means fabricated of an elastic material, means for sonically vibrating said resonator means at a frequency such as to effect resonant standing wave vibration thereof at a sonic frequency, container means for receiving said fluid and said material, and means for coupling sonic energy from said resonator means to said container means at a first point corresponding to an anti-node and a second point corresponding to a node of the standing wave vibration pattern formed along said resonator means.

14. Apparatus for sonically activating a fluid in the treatment of material with vibration comprising:

elongated resonator means fabricated of an elastic material, means for sonically vibrating said resonator means at a frequency such as to effect resonant standing wave vibration thereof at a sonic frequency, container means for receiving said fluid and said material, and means for coupling sonic energy from said resonator means to said container means at first and second points corresponding to first and second anti-nodes of the standing wave vibration pattern formed along said resonator means.

15. Apparatus for sonically activating a fluid in the treatment of material with vibration comprising:

first and second elongated resonator members fabricated of an elastic material, means for sonically vibrating said resonator members at a frequency such as to effect resonant standing wave vibration thereof at a sonic frequency, container means for receiving said fluid and said material, and means for coupling sonic energy from each of said resonator members to said container means at at least one point corresponding to an anti-node of the standing wave vibration pattern formed along each of said resonator members.

16. The apparatus of claim 15 wherein the container means comprises a casting having a chamber formed therein, said casting comprising the material being treated, and the fluid comprising a grit core within said chamber to be removed therefrom.

* * * * *